US008376220B2

(12) United States Patent
Shih et al.

(10) Patent No.: US 8,376,220 B2
(45) Date of Patent: Feb. 19, 2013

(54) AUTOMATIC TELLER MACHINE

(75) Inventors: Chih-Kun Shih, Santa Clara, CA (US); Yang-Jie Luo, Shenzhen (CN); Wan-Cheng Luo, Shenzhen (CN); Xiang-Xiong Xiao, Shenzhen (CN); Si-Long Li, Shenzhen (CN); Jie Peng, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 100 days.

(21) Appl. No.: 12/981,203

(22) Filed: Dec. 29, 2010

(65) Prior Publication Data

US 2011/0316395 A1 Dec. 29, 2011

(30) Foreign Application Priority Data

Jun. 28, 2010 (CN) ..... 2010 1 0211061

(51) Int. Cl.
*G07F 19/00* (2006.01)

(52) U.S. Cl. ..... 235/379; 312/270.2; 312/249.7; 312/334.44; 312/334.47

(58) Field of Classification Search ..... 235/375, 235/379, 380
See application file for complete search history.

(56) References Cited

U.S. PATENT DOCUMENTS

| | | | | |
|---|---|---|---|---|
| 3,462,203 | A * | 8/1969 | Vecchio | 384/19 |
| 5,483,047 | A * | 1/1996 | Ramachandran et al. | 235/379 |
| 5,740,744 | A * | 4/1998 | Nashirozawa et al. | 109/24.1 |
| 6,010,065 | A * | 1/2000 | Ramachandran et al. | 235/379 |
| 6,962,285 | B2 * | 11/2005 | Douglass et al. | 235/379 |
| 7,611,045 | B1 * | 11/2009 | Lute et al. | 235/379 |
| 7,744,175 | B2 * | 6/2010 | Peng et al. | 312/333 |
| 2005/0088069 | A1 * | 4/2005 | Greenwald et al. | 312/333 |
| 2007/0170830 | A1 * | 7/2007 | Huang | 312/334.47 |
| 2008/0164795 | A1 * | 7/2008 | Peng et al. | 312/334.5 |

* cited by examiner

*Primary Examiner* — Daniel Hess
*Assistant Examiner* — Paultep Savusdiphol
(74) *Attorney, Agent, or Firm* — Altis Law Group, Inc.

(57) ABSTRACT

An automatic teller machine includes a chassis, a user interface module; and a pair of sliding mechanisms. The user interface module is rotatably attached to the chassis. The pair of sliding mechanisms are attached to the chassis and the user interface. Each sliding mechanism includes a first rail and a second rail. The first rail is rotatably secured to the chassis. A second blocking member is located on the first rail. The second rail is rotatably secured to the user interface module and slidable on the first rail. A latch member with a latch portion is rotatably located on the second rail. The user interface module is rotatable between a closed position, where the latch portion is located away from the second blocking member, and an open position, where the latch portion engages with the second blocking member.

16 Claims, 15 Drawing Sheets

AUTOMATIC TELLER MACHINE

BACKGROUND

1. Technical Field

The present disclosure relates to an automatic teller machine.

2. Description of Related Art

An user interface module is provided in an automatic teller machine. The user interface module is usually secured to the automatic teller machine by screws. Generally, service or maintenance of the automatic teller machine is often needed. So it is very inconvenient when it comes to disassembling the interface module from the automatic teller machine.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
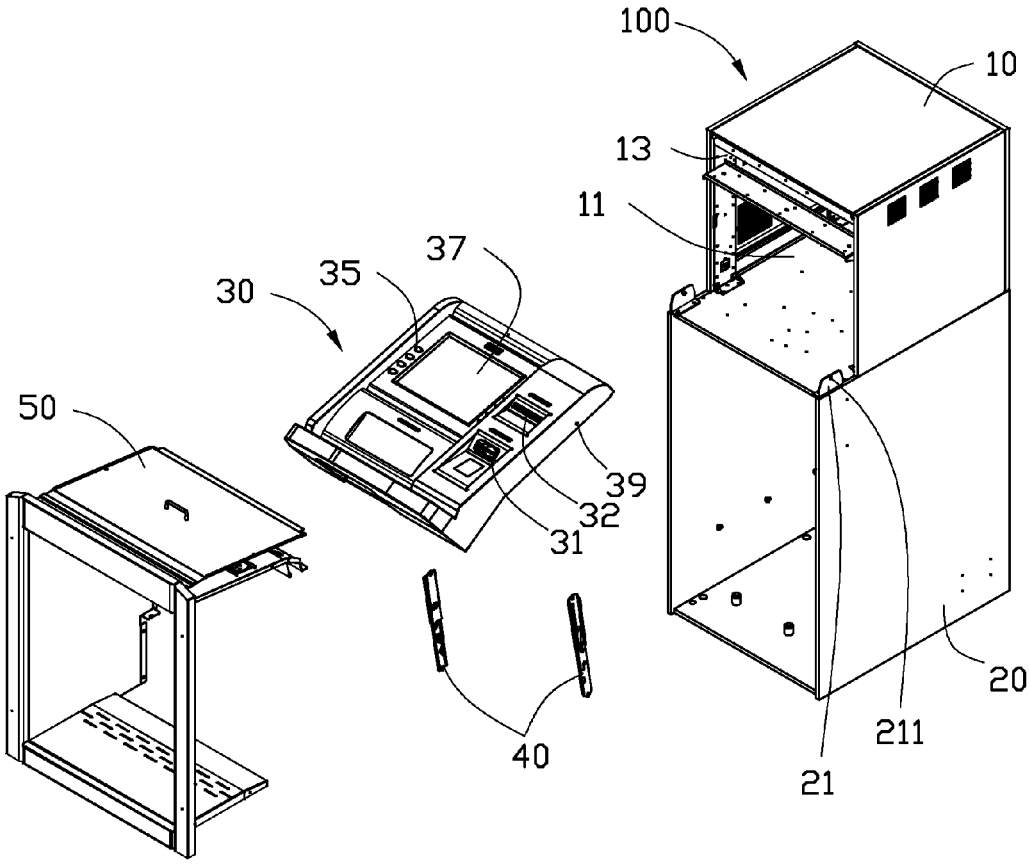
FIG. 1 is an exploded, isometric view of an automatic teller machine in accordance with an embodiment.

Referring to FIG. 1, an automatic teller machine, in accordance with an embodiment, includes a user interface module 30 and a chassis 100.

Figure 2:
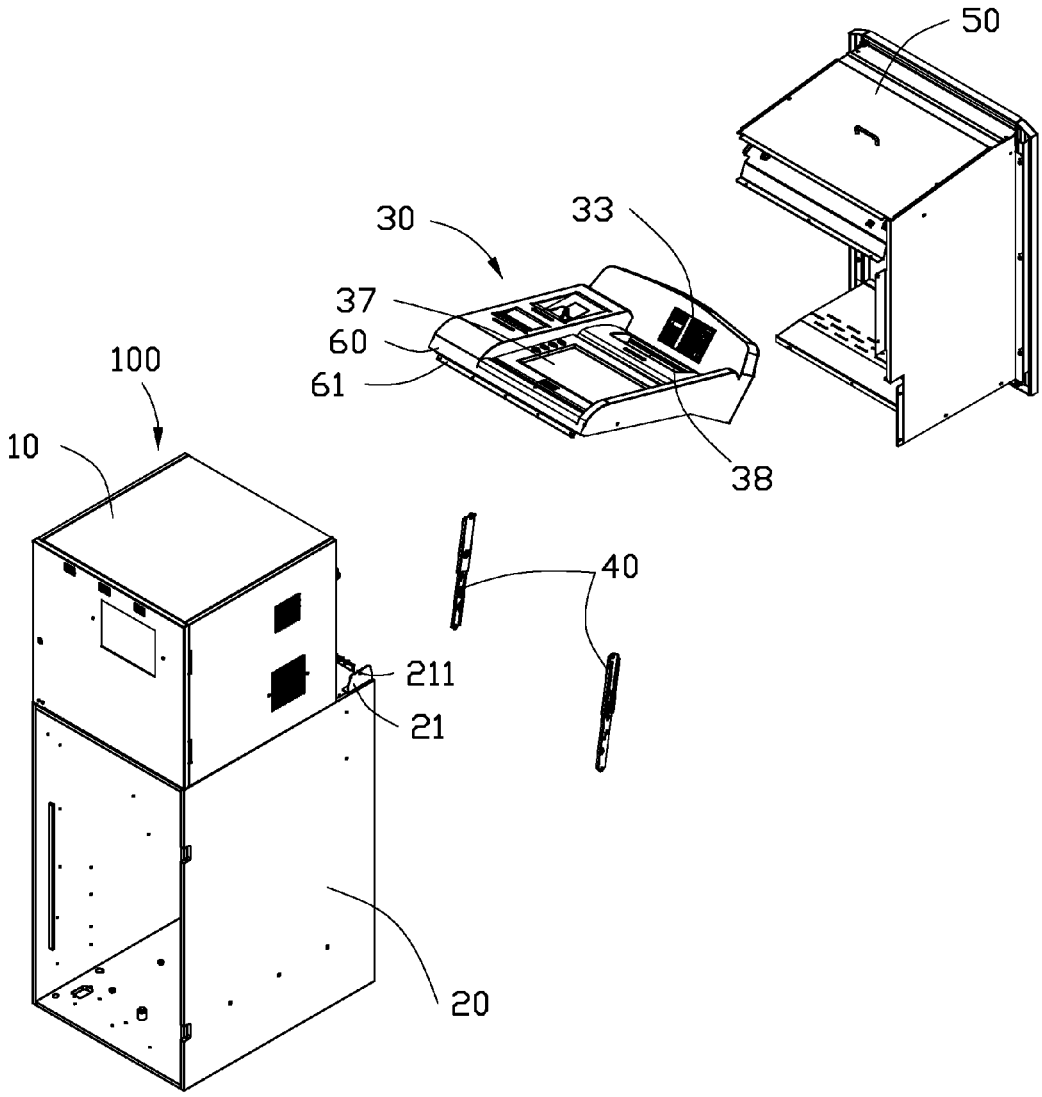
FIG. 2 is similar to FIG. 1, but viewed from a different aspect.

The user interface module 30 provides a screen 37, for showing information, such as user information and account information. A through slot 32 for outputting a receipt, a card reader 31, a keyboard (shown in FIG. 6) 33, a number of buttons 35, a cash dispenser 38 (shown in FIGS. 2 and 8) are located on the user interface module 30. In one embodiment, the card reader 31 is below the through slot 32, and the card reader 31 and the through slot 32 together are located a right side of the screen 37; the number of buttons 35 are located on a right side of the screen 37; the cash dispenser 38 is located between the keyboard 33 and the screen 37. In some embodiments, a top end of the user interface module 30 is rotatably attached to the chassis 100, by a known means (not shown), such as a hinge assembly. A pair of first pivot holes 39 is defined in opposite sides of the user interface module 30.

The chassis 100 includes a first box portion 10 and a second box portion 20. The first box portion 10 is located on the second box portion 20. A pair of pivot pieces 21 are located on the second box portion 20, adjacent the first box portion 10. Each pivot piece 21 defines a second pivot hole 211.

Figure 3:
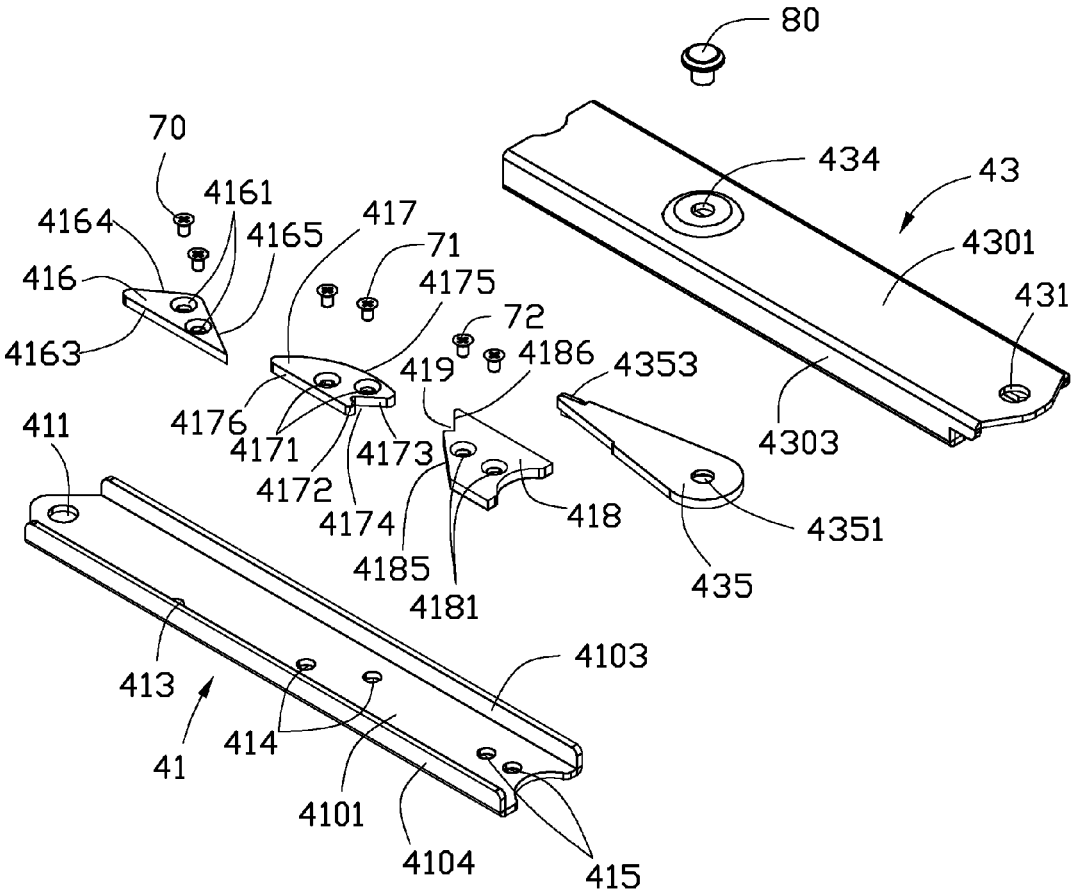
FIG. 3 is a partially exploded view of a sliding mechanism of FIG. 1.
Figure 4:
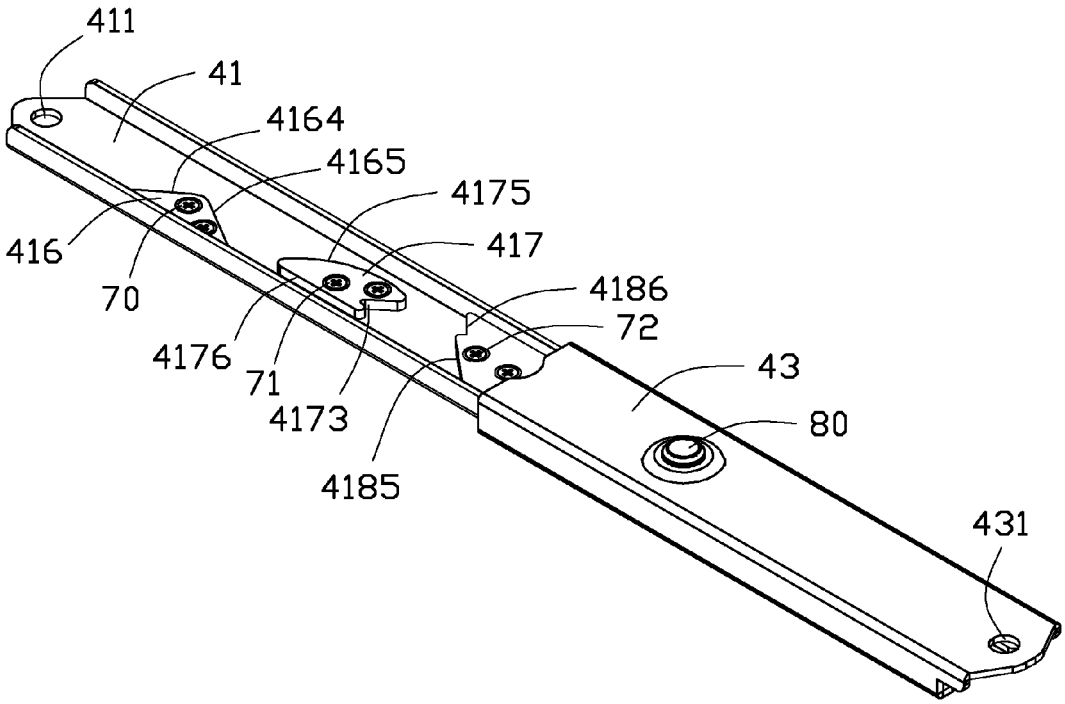
FIG. 4 is an assembled view of the sliding mechanism of FIG. 1.
Figure 5:
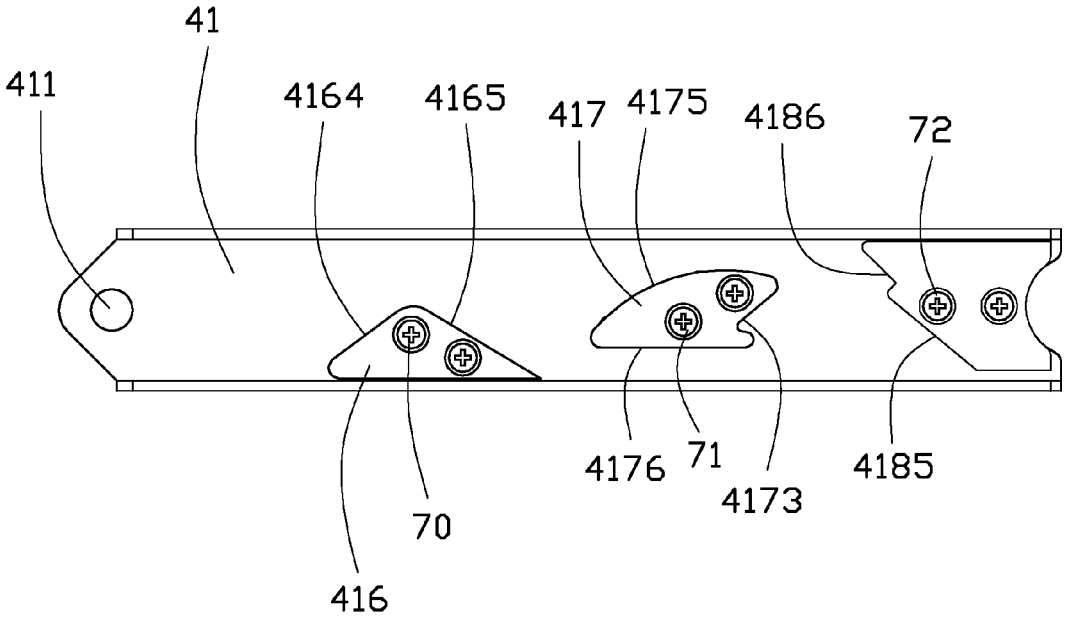
FIG. 5 is a front view of a first rail of FIG. 4.

A pair of sliding mechanisms 40 is provided to connect the user interface 30 to the chassis 100. Referring to FIGS. 3-5, each sliding mechanism includes a first rail 41 and a second rail 43.

The first rail 41 includes a base body 4101, a first sliding flange 4103 and a second sliding flange 4104. The first and second sliding flanges 4103, 4104 are located on opposite lengthwise edges of the base body 4101. A first securing hole 411, two second securing holes 413 (only one is shown in FIG. 3), two third securing holes 414, and two fourth securing holes 415 are defined in the first rail 41.

A first blocking member 416 is secured to the first rail 41. The first blocking member 416 defines two first positioning holes 4161, corresponding to the second securing holes 413. The first includes a first guiding edge 4163, a second guiding edge 4164, and a third guiding edge 4165 are connected in succession. An obtuse angle is defined between the second guiding edge 4164 and the third guiding edge 4165. Two first fasteners 70, such as screws, are screwed into the first positioning holes 4161 and the second securing holes 413, to secure the first blocking member 416 to the first rail 41. The first guiding edge 4163 is substantially parallel to the first and second slide flanges 4103, 4104 of the first rail 41 and abuts the second slide flanges 4104.

A second blocking member 417 defines two second positioning holes 4171, corresponding to the third securing holes 414. Two second fasteners 71, such as screws, are screwed in to the second positioning holes 4171 and the third securing holes 414. Thus, the second blocking member 417 is secured to the first rail 41, adjacent the first blocking member 416. The second blocking member 417 includes a first directing edge 4172, a second directing edge 4173, a third directing edge 4175 and a fourth directing edge 4176 connected in succession. A positioning slot 4174 is defined in the second blocking member 417 between the first and second directing edges 4172, 4173. In an embodiment, the third directing edge 4175 is substantially arc-shaped, and the fourth directing edge 4176 is substantially parallel to the first and second sliding flanges 4103, 4104 of the first rail 41.

A third blocking member 418 defines two third positioning holes 4181, corresponding to the fourth securing holes 415 of the first rail 41. Two third fasteners 72, such as screws, are screwed in the third positioning holes 4181 and the fourth securing holes 415, to secure the third blocking member 418 to the first rail 41. The third blocking member 418 includes a first leading edge 4185, a second leading edge 4186, connected in succession. A first acute angle is defined between the first leading edge 4185 and the first sliding flange 4103 of the first rail 41. And a second acute angel is defined between the second leading edge 4186 and the sliding first flange 4103. The second acute angle is greater than the first acute angle. A receiving slot 419 is defined between the first leading edge 4185 and the second leading edge 4186.

The second rail 43 includes a main body 4301 and two guide flanges 4303 located on opposite long edges of the main body 4301. A first locking hole 431 and a second locking hole 434 are defined in the main body 4301. A latch member 435 defines a mounting hole 4351, corresponding to the second locking hole 434. A fourth fastener 80, such as a screw, is screwed in the mounting hole 4351 and the second locking hole 434, to rotatably secure the latch member 435 to the second rail 43. A latch portion 4353 is located on a free end of the latch member 435, and the latch member 435 is rotatable when the latch portion 4353 is pushed.

Figure 7:
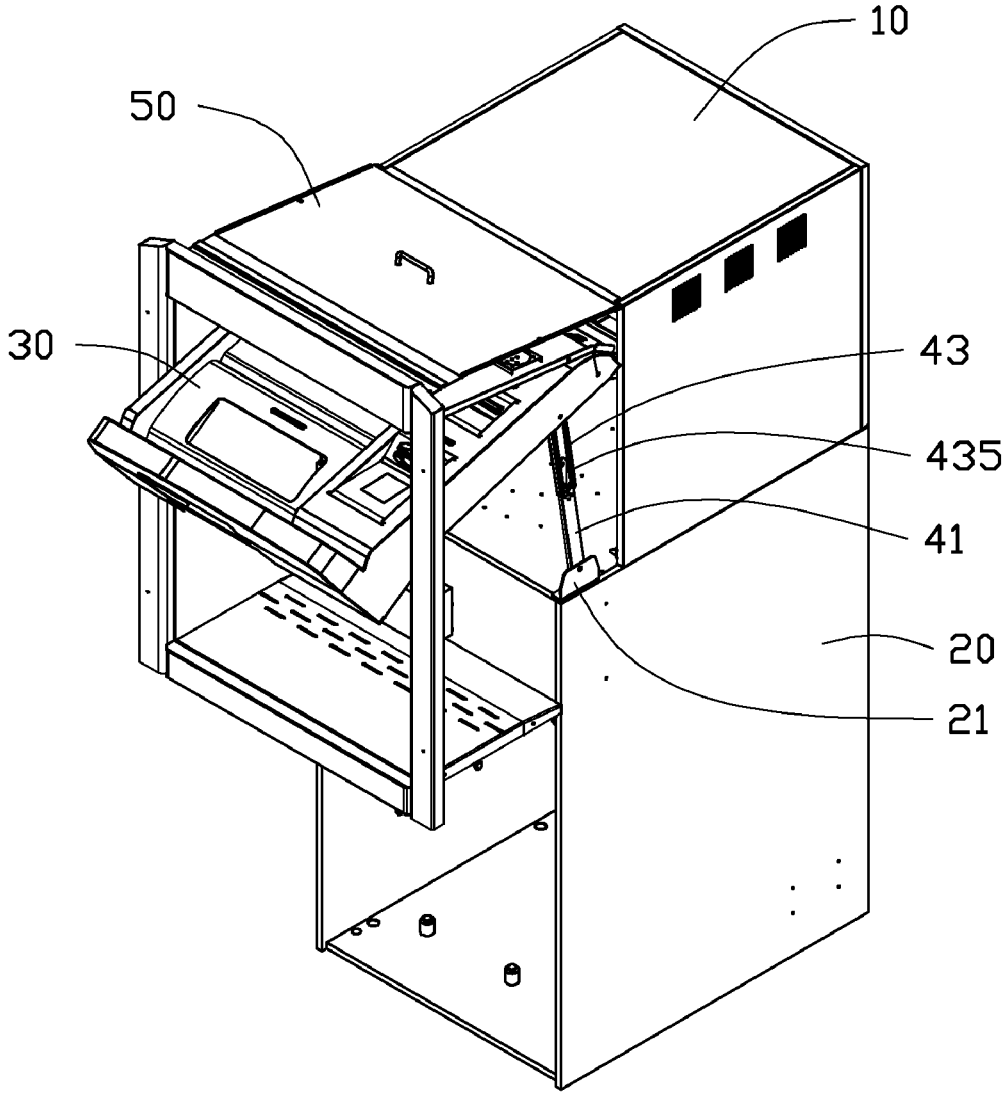
FIG. 7 is similar to FIG. 6, but shows the user interface module in an open position.

Referring to FIG. 4, in assembly, the first and second sliding flanges 4103, 4104 of the first rail 41 is slidably engaged with the guiding flanges 4303. The first to third blocking members 416, 417, 418 and the latch member 435 are located between the base body 4101 of the first rail 41 and the main body 4301 of the second rail 43. Referring to FIGS. 1 and 7, the first securing holes 411 of the first rails 41 are aligned with second pivot holes 211 of the pivot pieces 21. Two fifth fasteners (not shown), such as screws, are screwed in the first securing holes 411 and the second pivot holes 211, to rotatably secure the first rail 41 to the pivot pieces 21. The first locking holes 431 of the second rail 43 are aligned with the first pivot holes 39 of the user interface module 30. Two sixth fasteners (not shown), such as screws, are screwed in the first locking holes 431 and the first pivot holes 39, to rotatably secure the second rail 43 to the user interface module 30.

Figure 6:
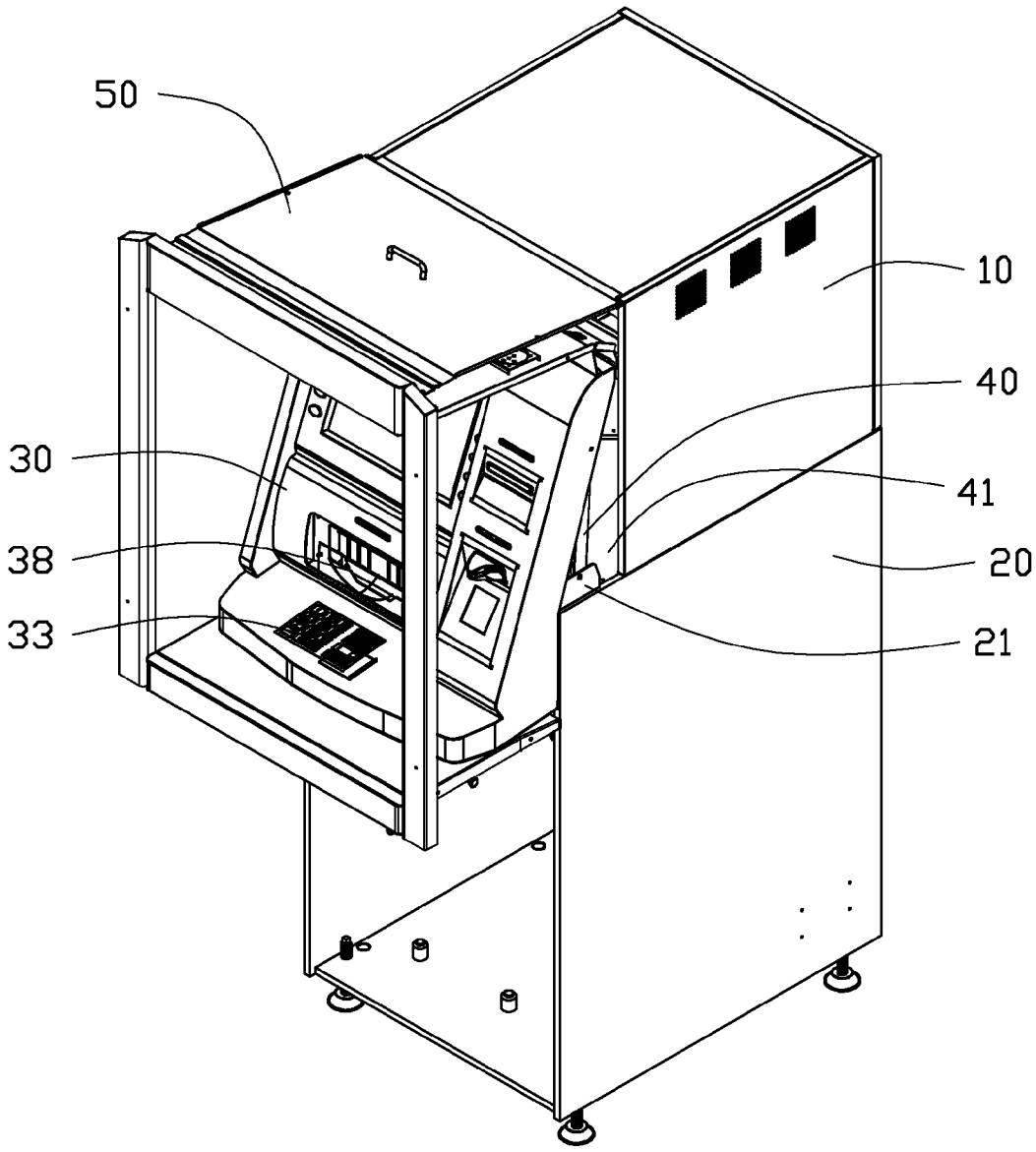
FIG. 6 is an assembled view of FIG. 1, showing a user interface module in a closed position.

Referring to FIGS. 1 and 6, a hood 50 is provided to be secured to the first and second box portions 10, 20, to cover the user interface module 30.

When the user interface module 30 is positioned in a closed position, in which the each sliding mechanism 40 has the shortest length (shown in FIG. 6). The latch portion 4353 of the latch member 435 is located at one side of the first blocking member 416, which is adjacent the first securing hole 411. When the user interface module 30 is rotated up for engagement between the user interface module 30 and the first box portion 10 to service or for maintenance, the second rail 43 is slid relative to the first rail 41, and the latch portion 4353 is slid towards the fourth securing holes 415.

Figure 8:
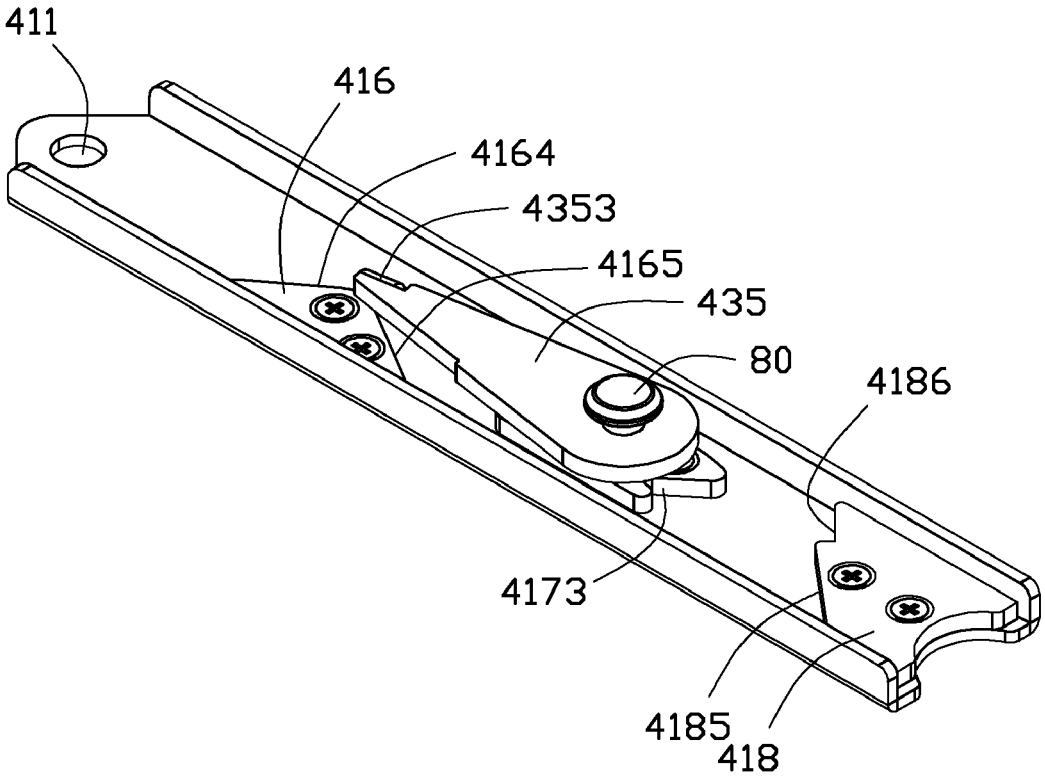
FIGS. 8-15, shows a latch member of a second rail of the sliding mechanism in different positions.
Figure 9:
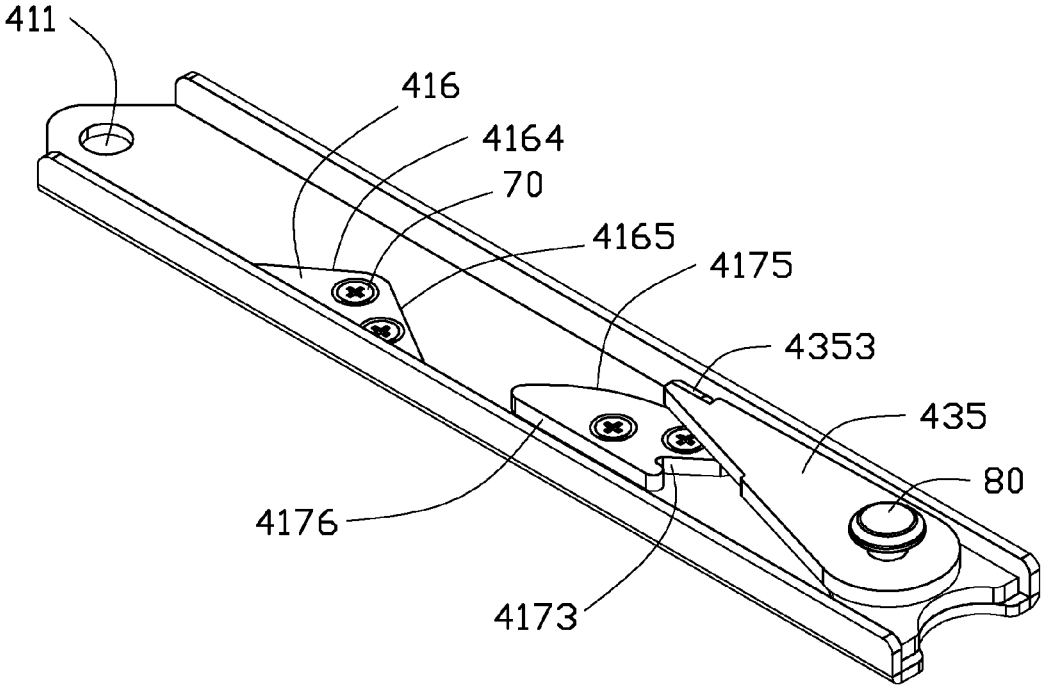
Figure 10:
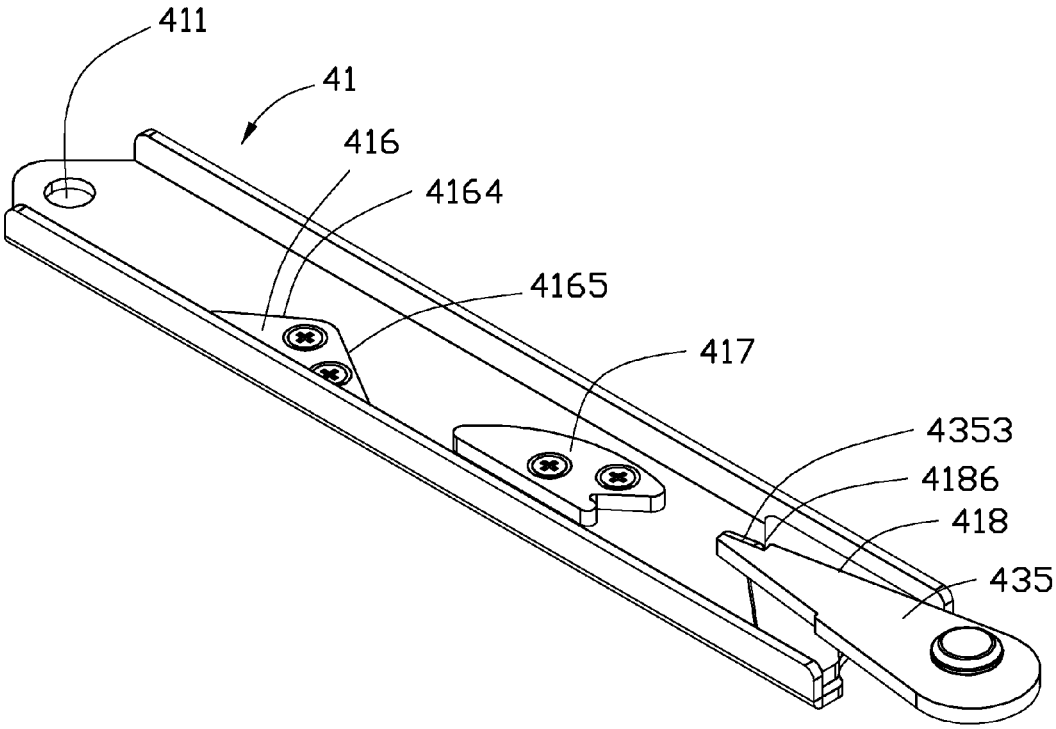

Referring to FIG. 8, the latch portion 4353 is slid along the second guiding edge 4164 of the first blocking member 416 to the joint of the second and the third guiding edges 4164, 4165. Referring to FIG. 9, the second rail 43 is further slid relative to the first rail 41, the latch portion 4353 is slid away from the first blocking member 416 until it abuts the third directing edge 4175. The latch portion 4353 is slid along the third directing edge 4175. Referring to FIG. 10, the latch portion 4353 is slid away from the second blocking member 417, until it abuts the second leading edge 4186 of the third blocking member 418. The latch portion 4353 is slid along the second leading edge 4186 until it is positioned in the receiving slot 419. The third blocking member 418 blocks the second rail 43 from further sliding relative to the first rail 41.

Figure 11:
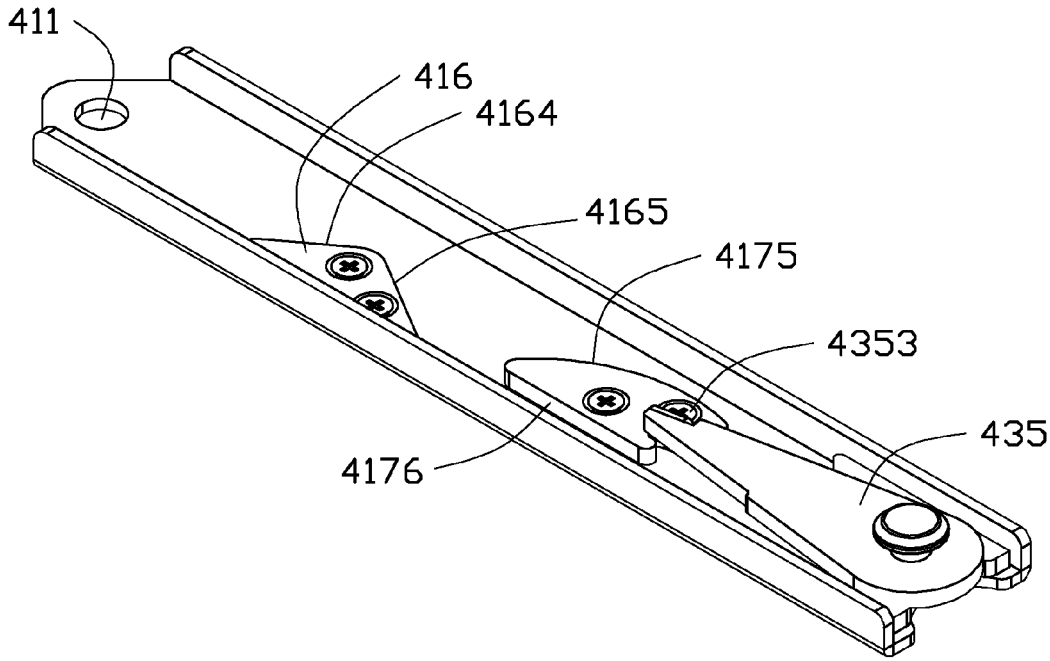
Figure 12:
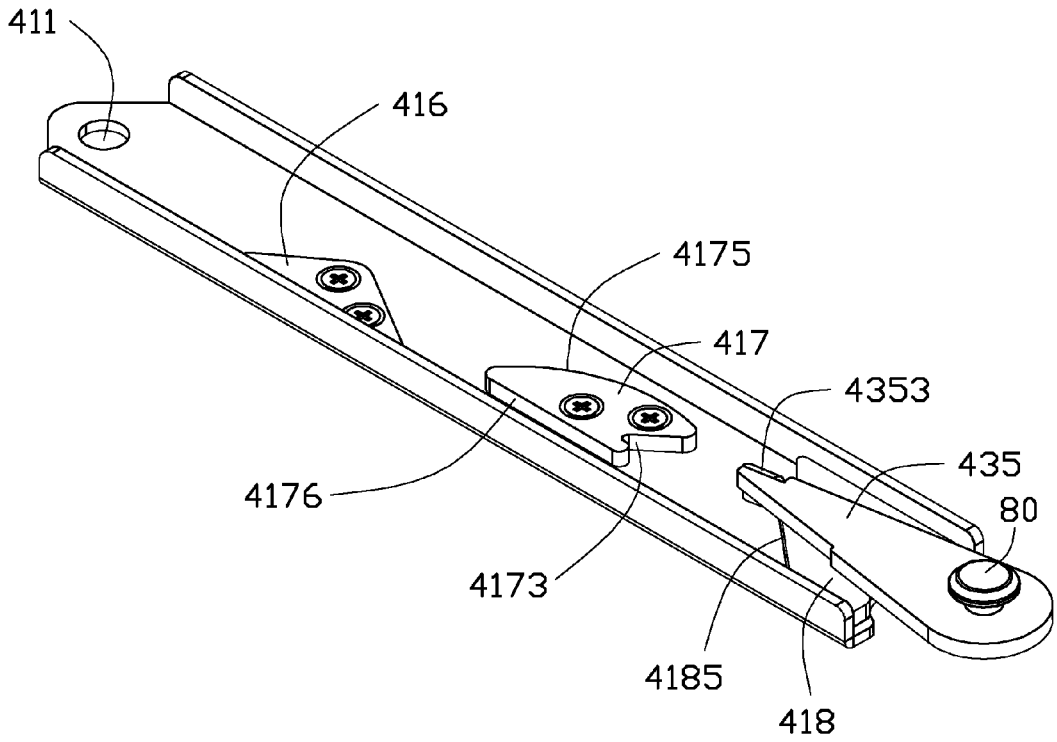
Figure 13:
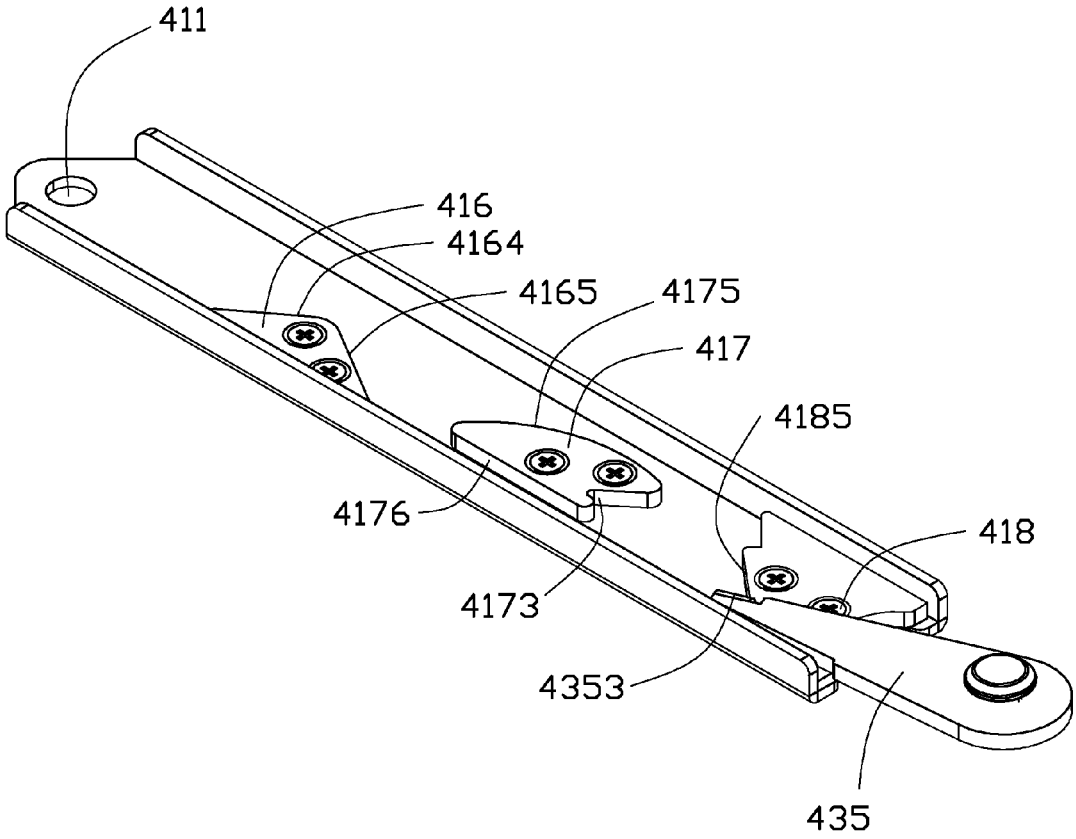
Figure 14:
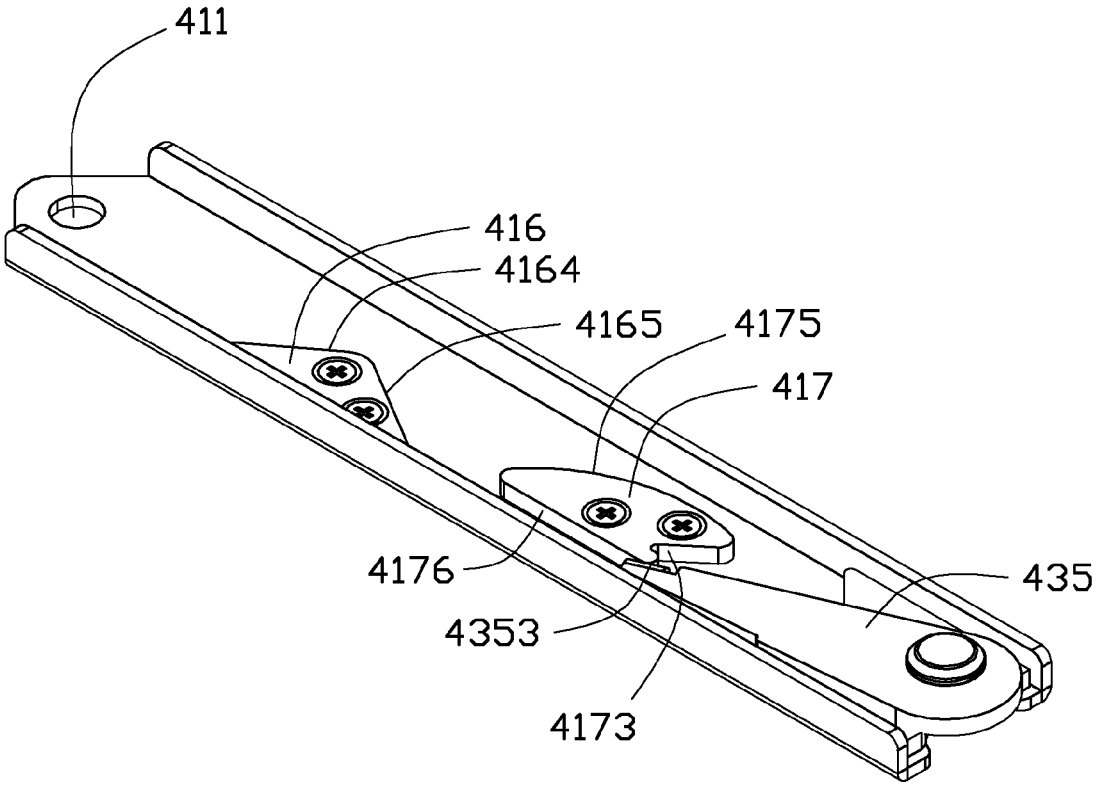
Figure 15:
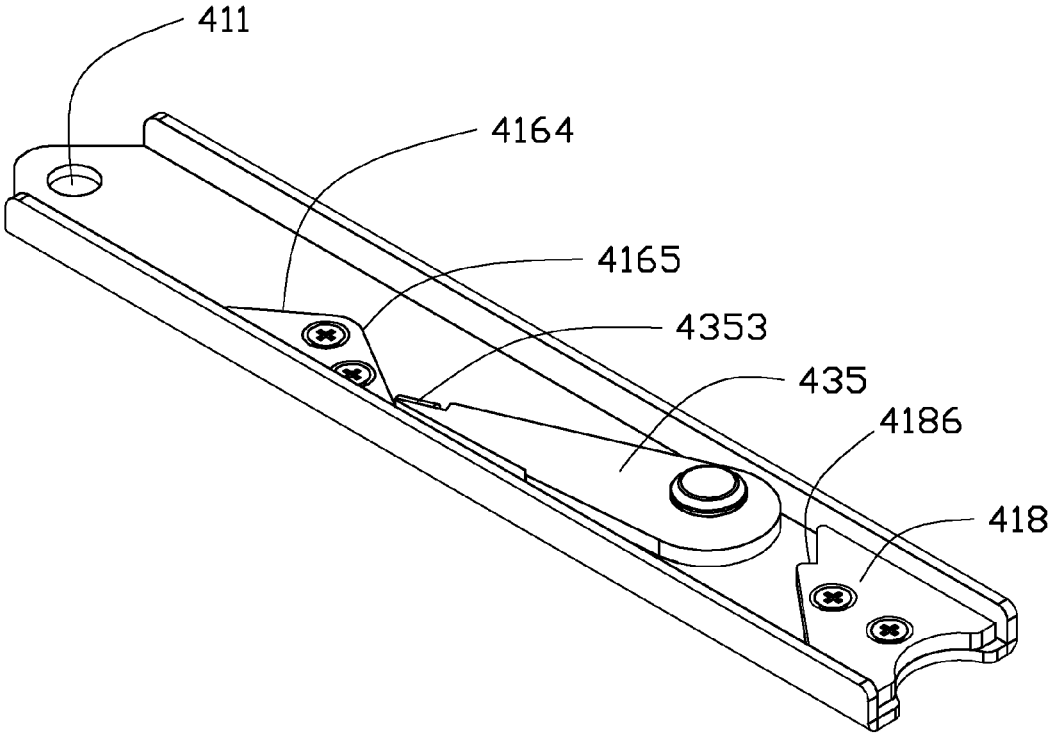

When the user interface module 30 is released, the second rail 43 is slid relative to the first rail 41 towards the first securing hole 411. The latch portion 4353 is slid away from the third blocking member 418 until it abuts the second directing edge 4173 of the second blocking member 417. Referring to FIG. 11, when the latch portion 4353 is engaged in the positioning slot 4174, the second rail 43 is blocked by the second blocking member 417 from sliding relative to the first rail 41. Therefore, the user interface module 30 is positioned in an open position.

After servicing or maintenance of the automatic teller machine is finished, the user interface module 30 should be closed. Referring to FIGS. 12-15, the user interface module 30 is first rotated up, the second rail 43 is slid relative to the first rail 41 towards the fourth securing holes 415. Therefore, the latch portion 4353 is slid away from the second blocking member 417 until it abuts the first leading edge 4185 of the third blocking member 418. The latch portion 4353 is slid along the first leading edge 4185 until blocked between the first leading edge 4185 and the second sliding flange 4104 of the first rail 41. The user interface module 30 is then rotated down. The latch portion 4353 passes across the second blocking member 417 through a space between the fourth directing edge 4176 and the adjacent sliding flange 4103. The latch portion 4353 abuts the third guiding edge 4165 and then slides along the third guiding edge 4165, until the latch portion 4353 passes across the first blocking member 416. Therefore, the user interface module 30 is positioned in the closed position again.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. An automatic teller machine comprising:

a chassis;

a user interface module rotatably attached to the chassis; and a pair of sliding mechanisms attached to the chassis and the user interface module, each sliding mechanism comprising:

a first rail rotatably secured to the chassis, and a second blocking member, separated from the first rail; and a second rail rotatably secured to the user interface module, the second rail being slidable on the first rail, and a latch member with a latch portion rotatably located on the second rail;

wherein the user interface module is rotatable between a closed position, where the latch portion is located away from the second blocking member, and an open position, where the latch portion engages with the second blocking member;

the first rail comprises a base body, a first sliding flange, and a second sliding flange substantially parallel to the first sliding flange; the first sliding flange and the second sliding flange are located on opposite edges of the base body; the second rail comprises a main body, and a pair of guiding flanges located on opposite edges of the main body; and the first sliding flange and the second sliding flange are slidably engaged with the pair of guiding flanges;

the second blocking member comprises a third directing edge, and a fourth directing edge connected to the third directing edge and being substantially a straight line; a first space is defined between the third directing edge and the first sliding flange; a second space is defined between the fourth directing edge and the second sliding flange; the first space and the second space are located on opposite sides of the second blocking member; and the first space and the second space is configured for the latch portion passing through;

a first blocking member is located on the first rail and comprises a first guiding edge, a second guiding edge, and a third guiding edge; the first guiding edge abuts the second sliding flange of the first rail; and an obtuse angle is defined between the second guiding edge and the third guiding edge; and the second guiding edge of the first blocking member is configured to rotate the latch member to have the latch portion abut the third directing edge of the second blocking member when the user interface module is rotated from the closed position to the open position; and the fourth directing edge of the second blocking member is configured to have the latch portion abut the third guiding edge after passing through the second space.

2. The automatic teller machine of claim 1, wherein the second blocking member further comprises a first directing edge and a second directing edge; the first directing edge is connected to the second directing edge and the fourth directing edge; the second directing edge is connected to the first directing edge and the third directing edge; a positioning slot is defined between the first directing edge and the second directing edge; and the latch portion is received in the positioning slot when the user interface module is in the open position.

3. The automatic teller machine of claim 2, wherein a third blocking member, separated from the first rail, for preventing the second rail sliding out of the first rail; the third blocking member comprises a first leading edge adjacent the second sliding flange and a second leading edge adjacent the first sliding flange; the first leading edge is configured to have the latch portion to abut the second directing edge of the second blocking member when the latch portion is moved from the third blocking member to the second blocking member; and the second directing edge of the second blocking member is configured to have the latch portion abut the first leading edge of the third blocking member when the latch portion is moved from the second blocking member to the third blocking member.

4. The automatic teller machine of claim 3, wherein the third blocking member defines a receiving slot between the first leading edge and the second leading edge.

5. The automatic teller machine of claim 3, wherein a first acute angle is defined between the first leading edge and the first sliding flange; a second acute angle is defined between the first leading edge and the first sliding flange; and the first acute angle is greater than or equal to the second acute angle.

6. The automatic teller machine of claim 1, wherein the third directing edge is substantially arc-shaped, and the fourth directing edge is substantially parallel to the first sliding flange of the first rail.

7. An automatic teller machine comprising:

a chassis;

a user interface module rotatably attached to the chassis; and a pair of sliding mechanisms attached to the chassis and the user interface module, each sliding mechanism comprising:

a first rail rotatably secured to the chassis, the first rail comprising a base body, a first sliding flange and a second sliding flange, that is substantially parallel to the first sliding flange and perpendicular to the base body; the first sliding flange and the second sliding flange are located on opposite edges of the base body; a second blocking member, separated from located on the first rail; a first space defined between the second blocking member and the first sliding flange, a second space defined between the second blocking member and the second sliding flange, and the first space and the second space located on opposite sides of the second blocking member; and a second rail rotatably secured to the user interface module, the second rail being slidable on the first rail, a latch member with a latch portion rotatably located on the second rail;

wherein the user interface module is rotatable between a closed position, where the sliding mechanism has a first length, and an open position, where the sliding mechanism has a second length greater than the first length; the latch portion is configured to pass through the first space when the user interface module is rotated from the closed position; and pass through the second space when the user interface module is rotated from the open position.

8. The automatic teller machine of claim 7, wherein the second rail comprises a main body and a pair of guiding flanges located on opposite edges of the main body; and the first sliding flange and the second sliding flange are slidably engaged with the pair of guiding flanges.

9. The automatic teller machine of claim 8, wherein the second blocking member comprises a third directing edge, and a fourth directing edge connected to the third directing edge and being substantially a straight line; the first space is defined between the third directing edge and the first sliding flange; the second space is defined between the fourth directing edge and the second sliding flange; and the first space and the second space is configured for the latch portion passing through.

10. The automatic teller machine of claim 9, wherein the second blocking member further comprises a first directing edge and a second directing edge; the first directing edge is connected to the second directing edge and the fourth directing edge; the second directing edge is connected to the first directing edge and the third directing edge; a positioning slot is defined between the first directing edge and the second directing edge; and the latch portion is received in the positioning slot when the user interface module is in the open position.

11. The automatic teller machine of claim 10, wherein a third blocking member, separated from the first rail, for preventing the second rail sliding out of the first rail; the third blocking member comprises a first leading edge, adjacent the second sliding flange, and a second leading edge, adjacent the first sliding flange; the first leading edge is configured to have the latch portion to abut the second directing edge of the second blocking member when the latch portion is moved from the third blocking member to the second blocking member; and the second directing edge of the second blocking member is configured to have the latch portion abut the first leading edge of the third blocking member when the latch portion is moved from the second blocking member to the third blocking member.

12. The automatic teller machine of claim 11, wherein the third blocking member defines a receiving slot between the first leading edge and the second leading edge.

13. The automatic teller machine of claim 11, wherein a first acute angle is defined between the first leading edge and the first sliding flange; a second acute angle is defined between the first leading edge and the first sliding flange; and the first acute angle is greater than or equal to the second acute angle.

14. The automatic teller machine of claim 9, wherein a first blocking member, separated from the first rail and comprises a first guiding edge, a second guiding edge, and a third guiding edge; the first guiding edge abuts the second sliding flange of the first rail; and an obtuse angle is defined between the second guiding edge and the third guiding edge.

15. The automatic teller machine of claim 14, wherein the second guiding edge of the first blocking member is configured to rotate the latch member to have the latch portion abut the third directing edge of the second blocking member when the user interface module is rotated from the closed position to the open position; and the fourth directing edge of the second blocking member is configured to have the latch portion abut the third guiding edge after passing through the second space.

16. The automatic teller machine of claim 9, wherein the third directing edge is substantially arc-shaped, and the fourth directing edge is substantially parallel to the first sliding flange of the first rail.

* * * * *